US010989357B2

(12) United States Patent
Bony et al.

(10) Patent No.: US 10,989,357 B2
(45) Date of Patent: Apr. 27, 2021

(54) SEALED AND THERMALLY INSULATING VESSEL HAVING AN ANTI-CONVECTIVE FILLER PLATE

(71) Applicant: GAZTRANSPORT ET TECHNIGAZ, Saint Remy les Chevreuse (FR)

(72) Inventors: Philippe Bony, Saint Remy les Chevreuse (FR); Bruno Deletre, Saint Remy les Chevreuse (FR); Nicolas Thenard, Saint Remy les Chevreuse (FR); Raphael Prunier, Saint Remy les Chevreuse (FR); Jean Zahra, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 16/642,675

(22) PCT Filed: Sep. 3, 2018

(86) PCT No.: PCT/FR2018/052151

§ 371 (c)(1),
(2) Date: Feb. 27, 2020

(87) PCT Pub. No.: WO2019/043348

PCT Pub. Date: Mar. 7, 2019

(65) Prior Publication Data

US 2020/0256514 A1 Aug. 13, 2020

(30) Foreign Application Priority Data

Sep. 4, 2017 (FR) ..... 1770929
Sep. 5, 2017 (FR) ..... 1770931

(51) Int. Cl.
*F17C 3/02* (2006.01)
*B63B 25/16* (2006.01)

(52) U.S. Cl.
CPC ..... *F17C 3/027* (2013.01); *B63B 25/16* (2013.01); *F17C 2203/0358* (2013.01);
(Continued)

(58) Field of Classification Search
CPC ..... F17C 3/027; F17C 2203/0358; F17C 2223/0161; F17C 2270/0105; B63B 25/16
See application file for complete search history.

(56) References Cited

U.S. PATENT DOCUMENTS

2017/0138536 A1* 5/2017 Bleomelen ..... F17C 3/025
2018/0073678 A1* 3/2018 Givoloup ..... F17C 13/004
(Continued)

FOREIGN PATENT DOCUMENTS

EP 0543686 A1 5/1993
FR 2413260 A1 7/1979
(Continued)

OTHER PUBLICATIONS

International Search Report for corresponding PCT application No. PCT/FR2018/052151, dated Jan. 2, 2019.

*Primary Examiner* — S. Joseph Morano
*Assistant Examiner* — Jovon E Hayes
(74) *Attorney, Agent, or Firm* — Notaro, Michalos & Zaccaria P.C.

(57) ABSTRACT

Sealed and thermally insulating tank for storing a fluid, a tank wall having a secondary thermal insulation barrier, a secondary sealing membrane, a primary thermal insulation barrier and a primary sealing membrane supported by the primary thermal insulation barrier, where the primary insulating elements have parallelepiped insulating panels disposed so as to provide voids between them. The primary thermal insulation barrier having an anti-convective filler plate disposed in the void between a first parallelepiped insulating panel and a second parallelepiped insulating
(Continued)

panel, the anti-convective filler plate being made of thin continuous material and having a plurality of elongated wall elements extending over substantially the entire width of the void to delimit cells extending substantially perpendicular to the thickness direction.

12 Claims, 7 Drawing Sheets

(52) U.S. Cl.
CPC ..... *F17C 2223/0161* (2013.01); *F17C 2223/033* (2013.01); *F17C 2227/0135* (2013.01); *F17C 2270/0105* (2013.01); *F17C 2270/0136* (2013.01)

(56) References Cited

U.S. PATENT DOCUMENTS

| | | | | |
|---|---|---|---|---|
| 2018/0180223 | A1* | 6/2018 | Boyeau | F17C 3/027 |
| 2018/0202611 | A1* | 7/2018 | Sassi | F17C 13/082 |

FOREIGN PATENT DOCUMENTS

| | | | | |
|---|---|---|---|---|
| FR | 3039248 | A1 | 1/2017 | |
| WO | 2012127141 | A1 | 9/2012 | |
| WO | 2013004943 | A1 | 1/2013 | |
| WO | 2014057221 | A2 | 4/2014 | |
| WO | 2014128414 | A1 | 8/2014 | |
| WO | WO-2014128414 | A1 * | 8/2014 | B63B 27/34 |
| WO | 2015132498 | A1 | 9/2015 | |
| WO | WO-2015132498 | A1 * | 9/2015 | F17C 3/027 |
| WO | 2016046487 | A1 | 3/2016 | |

* cited by examiner

SEALED AND THERMALLY INSULATING VESSEL HAVING AN ANTI-CONVECTIVE FILLER PLATE

TECHNICAL FIELD

The invention relates to the field of sealed and thermally insulating tanks with membranes, for storing and/or transporting a fluid, such as a cryogenic fluid.

Sealed and thermally insulating tanks with membranes are particularly used for storing liquefied natural gas (LNG), which is stored, at atmospheric pressure, at approximately −162° C. These tanks can be installed onshore or on a floating structure. In the case of a floating structure, the tank can be intended for transporting liquefied natural gas or for receiving liquefied natural gas used as fuel to propel the floating structure.

TECHNOLOGICAL BACKGROUND

In the prior art, sealed and thermally insulating tanks are known for storing liquefied natural gas, which tanks are integrated in a support structure, such as the double hull of a vessel intended to transport liquefied natural gas. In general, such tanks comprise a multilayer structure successively having, in the thickness direction, from the outside to the inside of the tank, a secondary thermal insulation barrier retained in the support structure, a secondary sealing membrane resting against the secondary thermal insulation barrier, a primary thermal insulation barrier resting against the secondary sealing membrane, and a primary sealing membrane resting against the primary thermal insulation barrier and intended to be in contact with the liquefied natural gas contained in the tank.

Document WO 2016/046487 discloses a secondary thermal insulation barrier and a primary thermal insulation barrier formed by juxtaposed insulating panels. In this document WO 2016/046487, the secondary sealing membrane is made up of a plurality of metal sheets comprising corrugations projecting toward the outside of the tank and thus allowing the secondary sealing membrane to deform under the effect of the thermal and mechanical stresses generated by the fluid stored in the tank. An internal face of the insulating panels of the secondary thermal insulation barrier has grooves receiving the corrugations of the corrugated metal sheets of the secondary sealing membrane. These corrugations and these grooves form a meshwork of channels extending along the walls of the tank.

SUMMARY

One idea behind the invention is to propose a sealed and thermally insulating tank with a sealing membrane comprising corrugations, in which the convection phenomena are reduced. In particular, one idea behind the invention is to provide a sealed and thermally insulating tank limiting the presence of continuous circulation channels in the thermal insulation barriers, in order to limit the natural convection phenomena in said thermal insulation barriers.

According to one embodiment, the invention provides a sealed and thermally insulating tank for storing a fluid, wherein a tank wall comprises, successively in a thickness direction, a secondary thermal insulation barrier comprising a plurality of juxtaposed secondary insulating elements, the secondary insulating elements being retained against a support wall, for example, by secondary retention components, a secondary sealing membrane supported by the secondary insulating elements of the secondary thermal insulation barrier, a primary thermal insulation barrier comprising a plurality of juxtaposed primary insulating elements, the primary insulating elements being retained against the secondary sealing membrane, for example, by primary retention components, and a primary sealing membrane supported by the primary thermal insulation barrier and intended to be in contact with the cryogenic fluid contained in the tank.

According to the embodiments, such a tank can comprise one or more of the following features.

According to one embodiment, the secondary sealing membrane is a corrugated metal membrane comprising a series of parallel corrugations forming channels, in particular very long channels in accordance with the dimensions of the tank, and flat portions located between said corrugations, the primary insulating elements having an external face, which external face can be flat, covering the flat portions of the secondary sealing membrane, the secondary insulating elements having an internal face, which can be flat, supporting the flat portions of the secondary sealing membrane, with anti-convection filler elements being disposed in the corrugations of the secondary sealing membrane to generate a load loss in said channels.

By virtue of these features, it is possible to limit the convection phenomena along the corrugations of the secondary sealing membrane, in particular in the tank walls that have a vertical or oblique orientation in the gravitational field, in which walls a temperature gradient between the upper part and the lower part of the wall is likely to promote such a phenomenon.

According to one embodiment, the corrugations of the secondary sealing element project toward the outside of the tank toward the support structure.

According to one embodiment, the anti-convection filler elements disposed in the corrugations of the secondary sealing membrane are covered by the external face of the primary insulating elements.

According to one embodiment, the anti-convection filler elements disposed in the corrugations of the secondary sealing membrane are fixed to the external face of the primary insulating elements.

According to one embodiment, the anti-convection filler elements disposed in the corrugations of the secondary sealing membrane are fixed, for example, bonded, to the secondary sealing membrane.

According to one embodiment, the secondary insulating elements have grooves hollowed out of the internal face for receiving the corrugations of the secondary sealing membrane, with additional anti-convection filler elements being disposed in said grooves between the secondary sealing membrane and the secondary insulating elements to generate a load loss in a remaining portion of said grooves located around the corrugations of the secondary sealing membrane.

According to one embodiment, the corrugations of the secondary sealing membrane project toward the inside of the tank.

According to one embodiment, the anti-convection filler elements disposed in the corrugations of the secondary sealing membrane are supported by the internal face of the secondary insulating elements.

According to one embodiment, the primary insulating elements have grooves hollowed out of the external face for receiving the corrugations of the secondary sealing membrane, with additional anti-convection filler elements being disposed in said grooves between the secondary sealing membrane and the primary insulating elements to generate a load loss in a remaining portion of said grooves located around the corrugations of the secondary sealing membrane.

According to one embodiment, the primary sealing membrane is a corrugated metal membrane comprising a series of parallel corrugations forming channels, in particular very long channels in accordance with the dimensions of the tank, and flat portions located between said corrugations, with the primary insulating elements having an internal face supporting the flat portions of the primary sealing membrane.

According to one embodiment, the corrugations of the primary sealing membrane project toward the outside of the tank toward the support structure.

According to one embodiment, the primary insulating elements have grooves hollowed out of the internal face for receiving the corrugations of the primary sealing membrane, with additional anti-convection filler elements being disposed in said grooves between the primary sealing membrane and the primary insulating elements to generate a load loss in a remaining portion of said grooves located around the corrugations of the primary sealing membrane.

According to one embodiment, the anti-convection filler elements comprise an elongated filler part disposed in a corrugation of the secondary sealing membrane, and/or the primary sealing membrane, the elongated filler part having a section shape that fills at least 80% of the section of the corrugation in the assembled state of the tank and, for example, the entire section of the corrugation. The elongated filler part can assume numerous section shapes. For example, the elongated filler part can assume a section shape matching the section shape of the corrugation or even a circular, elliptical or other section shape.

According to one embodiment, the filler part disposed in a corrugation comprises parallel grooves oriented transverse to the length of the filler part and distributed along the length of the filler part.

According to one embodiment, the secondary sealing membrane, and/or the primary sealing membrane, comprises a first series of parallel corrugations and a second series of parallel corrugations, which is transverse to the first series of corrugations and which intersects the first series of corrugations at node zones, the anti-convection filler elements comprising node parts disposed in the node zones of the secondary sealing membrane, and/or the primary sealing membrane.

According to one embodiment, an anti-convection filler element or an additional anti-convection filler element is made of expanded polystyrene or of polymer foam or of glass wool.

According to one embodiment, an anti-convection filler element or an additional anti-convection filler element is made of flexible synthetic material or of molded synthetic material.

According to one embodiment, the primary insulating elements comprise parallelepiped insulating panels disposed so as to provide voids between them, the primary thermal insulation barrier further comprising an anti-convection cover strip made of continuous, preferably thin, material and disposed along an edge of a first parallelepiped insulating panel, so as to substantially seal the void between said first parallelepiped insulating panel and a second parallelepiped insulating panel, the second parallelepiped insulating panel being adjacent to the first parallelepiped insulating panel, the anti-convection cover strip comprising a first edging portion disposed on the internal face of the first parallelepiped insulating panel.

By virtue of these features, it is possible to limit the convection phenomena in the voids between parallelepiped insulating panels, in particular in the thickness direction of the tank wall. In particular, such an anti-convection cover strip can be installed with ease even if the void is narrow.

The first edging portion of the anti-convection cover strip can be fixed on the first parallelepiped insulating panel or under the primary membrane, in particular bonded or clasped on the internal face of the first parallelepiped insulating panel. The edging opposite the anti-convection cover strip preferably is left free.

According to one embodiment, the internal face of the first parallelepiped insulating panel comprises a countersink along the void for accommodating the first edging portion of the anti-convection cover strip.

By virtue of these features, it is possible to accommodate and to fix the anti-convection cover strip without affecting the flatness of the internal face of the parallelepiped insulating panel that supports the sealing membrane.

According to one embodiment, the anti-convection cover strip straddles the void between the first parallelepiped insulating panel and the second parallelepiped insulating panel, the anti-convection cover strip having a second edging portion opposite the first edging portion and disposed on the internal face of the second parallelepiped insulating panel.

According to one embodiment, the internal face of the second parallelepiped insulating panel comprises a countersink along the void for accommodating the second edging portion of the anti-convection cover strip.

According to one embodiment, the width of the first and/or of the second edging portion is greater than 10 mm.

According to one embodiment, the anti-convection cover strip comprises a folded portion that is engaged in the void between the first parallelepiped insulating panel and the second parallelepiped insulating panel, the folded portion comprising a first side extending toward the outside in the thickness direction of the tank wall, from the first edging portion, and a second side extending toward the inside in the thickness direction of the tank wall. In this case, the anti-convection cover strip preferably is made of flexible material.

According to one embodiment, the folded portion comes into abutment against a lateral face of the second parallelepiped insulating panel bordering the void. In this case, it is not essential for the cover strip to project over the internal face of the second insulating panel.

According to one embodiment, the length of the anti-convection cover strip is greater than the length of said edge of the first parallelepiped insulating panel, so as to at least project over a third parallelepiped insulating panel, with the third parallelepiped insulating panel being adjacent to the first parallelepiped insulating panel.

According to one embodiment, the first parallelepiped insulating panel also supports a second anti-convection cover strip made of thin continuous material and disposed along an edge of the first parallelepiped insulating panel turned toward the third parallelepiped insulating panel, so as to substantially seal the void between said first parallelepiped insulating panel and the third parallelepiped insulating panel, the second anti-convection cover strip comprising a first edging portion installed or fixed on the internal face of the first parallelepiped insulating panel.

According to one embodiment, the first and second anti-convection cover strips are made up of a single piece of thin continuous material cut into an L shape.

The anti-convection cover strip can be made of flexible or rigid materials, for example, that are less than 2 mm thick, even less than or equal to 1 mm thick. According to one embodiment, the anti-convection cover strip is made of a material selected from paper, cardboard, polymer films and composite polymer resin and fiber based materials.

According to one embodiment, the width of the void between the first parallelepiped insulating panel and the second parallelepiped insulating panel is less than 10 mm.

According to one embodiment, the primary insulating elements comprise parallelepiped insulating panels disposed so as to provide voids between them, the primary thermal insulation barrier further comprising an anti-convection filler plate disposed in the void between a first parallelepiped insulating panel and a second parallelepiped insulating panel, the second parallelepiped insulating panel being adjacent to the first parallelepiped insulating panel, the anti-convection filler plate being made of thin continuous material and having a plurality of elongated wall elements extending over substantially the entire width of the void to delimit cells substantially extending perpendicular to the thickness direction.

By virtue of such a filler plate, it is possible to limit the convection phenomena in the voids between parallelepiped insulating panels, in particular in the thickness direction of the tank wall. Preferably, the filler plate is made of relatively flexible material, such as paper, cardboard, plastic sheeting, in particular polyetherimide or even polyamide-imide, so that the cells can be easily crushed and thus adapt themselves to the width of the void.

The length of such a filler plate can be greater than, smaller than or substantially equal to the length of the edges of the parallelepiped insulating panels between which the void is formed.

Such a filler plate particularly can be interrupted or cut at the site of the primary retention components, at least when the primary retention components are also disposed in the voids.

According to one embodiment, the elongated wall elements are formed by successive portions of a sheet of corrugated material having alternated parallel corrugations extending substantially perpendicular to the thickness direction.

According to one embodiment, the filler plate has a sandwich structure comprising two parallel continuous sheets spaced apart by said elongated wall elements, said two parallel continuous sheets being arranged against two lateral faces of the first and of the second parallelepiped insulating panel delimiting the void. In such a sandwich structure, the width of the cells is actually equal to the width of the void less the thickness of the two parallel continuous sheets.

According to one embodiment, the elongated wall elements are formed by cylindrical elements extending substantially perpendicular to the thickness direction and fixed between the two parallel continuous sheets. Such cylindrical elements can assume any section shape, for example, hexagonal, circular or other.

According to one embodiment, at least one of the two parallel continuous sheets spaced apart by said elongated wall elements comprises an upper edging portion folded and fixed on the internal face of at least one of the two parallelepiped insulating panels between which the void is formed.

According to one embodiment, the internal face of the first and/or of the second parallelepiped insulating panel comprises a countersink along the void for accommodating said upper edging portion of the continuous sheet.

By virtue of these features, it is possible to accommodate and to fix the upper edging portion of the continuous sheet without affecting the flatness of the internal face of the parallelepiped insulating panel that supports the sealing membrane.

According to one embodiment, the width of the void between the first parallelepiped insulating panel and the second parallelepiped insulating panel is less than 10 mm.

Such a tank can form part of an onshore storage installation, for example, for storing LNG, or can be installed in a floating, coastal or deep sea structure, in particular an LNG tanker vessel, an LNG tanker, a floating storage and regasification unit (FSRU), an offshore floating production and storage unit (FPSO), among others.

According to one embodiment, a vessel for transporting a cold liquid product comprises a double hull and an aforementioned tank disposed in the double hull.

According to one embodiment, the invention also provides a method for loading or offloading such a vessel, wherein a fluid is routed through insulated pipelines, from or to a floating or onshore storage installation, to or from the tank of the vessel.

According to one embodiment, the invention also provides a transfer system for a fluid, the system comprising the aforementioned vessel, insulated pipelines arranged so as to connect the tank installed in the hull of the vessel to a floating or onshore storage installation, and a pump for conveying a fluid through the insulated pipelines, from or to the floating or onshore storage installation, to or from the tank of the vessel.

BRIEF DESCRIPTION OF THE FIGURES

The invention will be better understood, and further aims, details, features and advantages thereof will become more clearly apparent throughout the following description of a plurality of particular embodiments of the invention, which are provided solely by way of a non-limiting illustration, with reference to the accompanying drawings, in which.

DETAILED DESCRIPTION OF EMBODIMENTS

By convention, the terms "external" and "internal" are used to define the relative position of one element relative to another, preferably inside and outside the tank.

Figure 1:
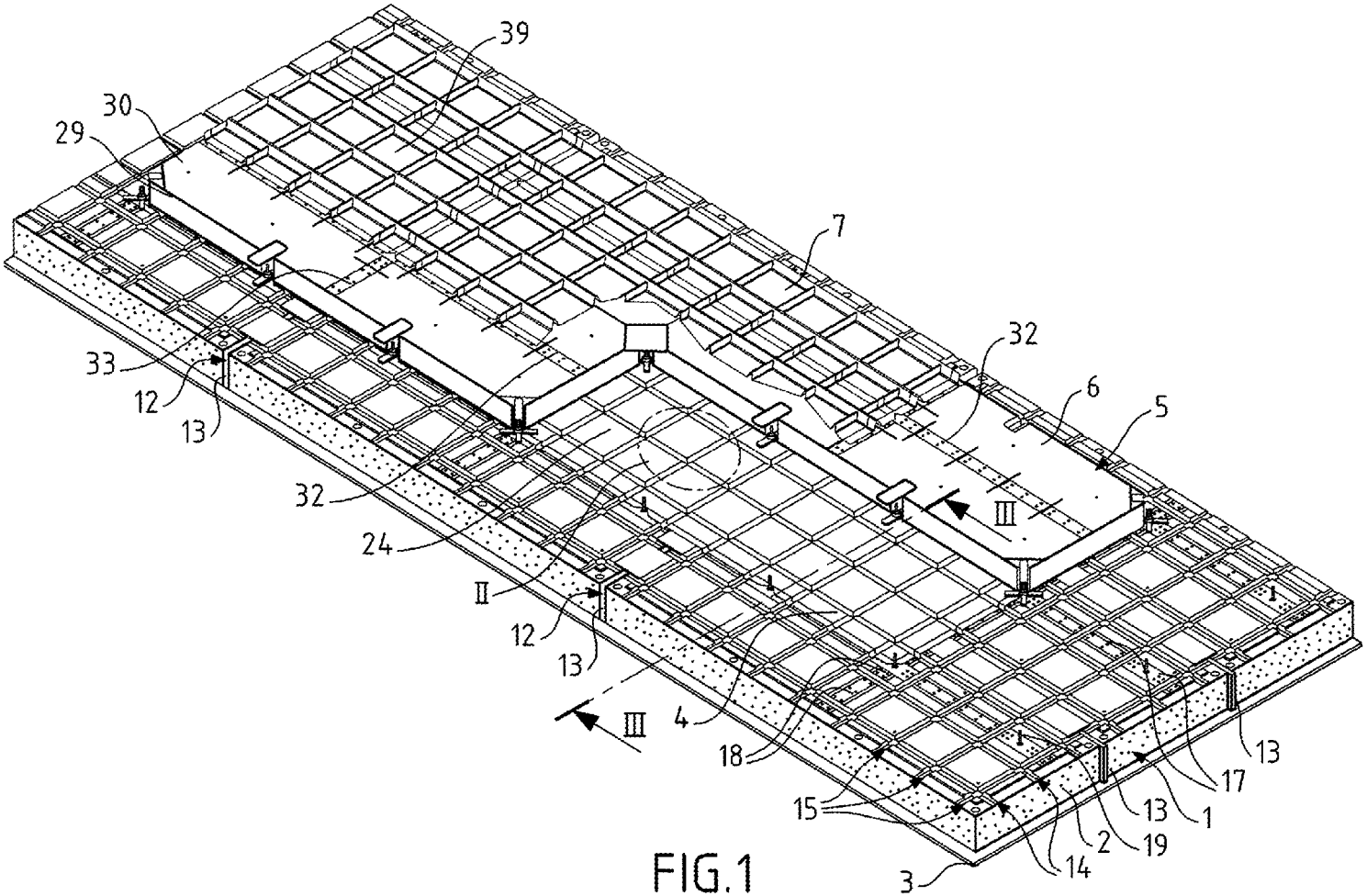
FIG. 1 is a cutaway perspective view of a wall of a sealed and thermally insulating tank for storing a fluid.

FIG. 1 shows the multilayer structure of a wall of a sealed and thermally insulating tank for storing a fluid.

Such a tank wall comprises, from the outside to the inside of the tank, a secondary thermal insulation barrier 1 comprising secondary insulating panels 2 that are juxtaposed and anchored to a support structure 3 by secondary retention components (not shown), for example, studs welded to the support structure 3, a secondary sealing membrane 4 supported by the secondary insulating panels 2 of the secondary thermal insulation barrier 1, a primary thermal insulation barrier 5 comprising primary insulating panels 6 that are juxtaposed and anchored to the secondary insulating panels 2 of the secondary thermal insulation barrier 1 by primary retention components 19 and a primary sealing membrane 7, supported by the primary insulating panels 6 of the primary thermal insulation barrier 5 and intended to be in contact with the cryogenic fluid contained in the tank.

The support structure 3 particularly can be a self-supporting metal sheet or, more generally, any type of rigid partition having suitable mechanical properties. The support structure 3 particularly can be formed by the hull or the double hull of a vessel. The support structure 3 comprises a plurality of walls defining the general shape of the tank, commonly a polyhedric shape.

The secondary insulating panels 2 substantially have a rectangular parallelepiped shape. The secondary insulating panels 2 each comprise an insulating lining layer 9, for example, an insulating polymer foam 9, sandwiched between an internal rigid plate 10 and an external rigid plate 11. The internal 10 and external 11 rigid plates are, for example, plywood boards bonded onto said insulating polymer foam layer 9. The insulating polymer foam particularly can be a polyurethane based foam. The polymer foam advantageously is reinforced with glass fibers that help to reduce its thermal contraction.

The secondary insulating panels 2 are juxtaposed in parallel rows and are separated from one another by voids 12 ensuring a functional assembly clearance. The voids 12 are filled with a heatproof lining 13, shown in FIGS. 1 and 7, such as glass wool, rock wool or flexible open cell synthetic foam, for example. The heatproof lining 13 advantageously is made of a porous material so as to allow gas to circulate in the voids 12 between the secondary insulating panels 2, for example, allowing an inert gas, such as nitrogen, to circulate inside the secondary thermal insulation barrier 1, so as to keep it under an inert atmosphere and thus prevent combustible gas from being found within an explosive concentration range and/or so as to place the secondary thermal insulation barrier 1 in negative pressure in order to increase its insulating capability. This circulation of gas is also important for facilitating the detection of possible combustible gas leaks. The width of the voids 12 is approximately 30 mm, for example.

The internal plate 10 has two series of grooves 14, 15 perpendicular to each other, so as to form a network of grooves. Each series of grooves 14, 15 is parallel to two opposite sides of the secondary insulating panels 2. The grooves 14, 15 are intended to receive corrugations 25, 26, projecting toward the outside of the tank, formed on the metal sheets 24 of the secondary sealing membrane 4. In the embodiment shown in FIG. 1, the internal plate 10 comprises three grooves 14 extending in the longitudinal direction of the secondary insulating panel 2 and nine grooves 15 extending in the transverse direction of the secondary insulating panel 2.

Furthermore, the internal plate 10 is equipped with metal mounting plates 17, 18 for anchoring the edge of the corrugated metal sheets 24 of the secondary sealing membrane 4 on the secondary insulating panels 2. The metal mounting plates 17, 18 extend in two perpendicular directions that are each parallel to two opposite sides of the secondary insulating panels 2. The metal plates 17, 18 are fixed on the internal plate 10 of the secondary insulating panel 2, by screws, rivets or clasps, for example. The metal mounting plates 17, 18 are placed in recesses provided in the internal plate 10, so that the internal surface of the metal mounting plates 17, 18 is flush with the internal surface of the internal plate 10. The internal plate 10 has an internal surface that is substantially flat, apart from possible singular zones such as the grooves 14, 15 or the countersinks for housing the metal mounting plates 17, 18.

The internal plate 10 is also equipped with threaded studs 19 projecting toward the inside of the tank and intended to fix the primary thermal insulation barrier 5 on the secondary insulating panels 2 of the secondary thermal insulation barrier 1. The metal studs 19 pass through orifices arranged in the metal mounting plates 17.

The secondary sealing membrane 4 comprises a plurality of corrugated metal sheets 24, each having a substantially rectangular shape. The corrugated metal sheets 24 are disposed offset relative to the secondary insulating panels 2 of the secondary thermal insulation barrier 1, so that each of said corrugated metal sheets 24 jointly extends over four adjacent secondary insulating panels 2.

Each corrugated metal sheet 24 has a first series of parallel corrugations 25 extending in a first direction and a second series of parallel corrugations 26 extending in a second direction. The directions of the series of corrugations 25, 26 are perpendicular. Each of the series of corrugations 25, 26 is parallel to two opposite edges of the corrugated metal sheet 24. The corrugations 25, 26 project toward the outside of the tank, i.e. toward the support structure 3. The corrugated metal sheet 24 comprises, between the corrugations 25, 26, a plurality of flat surfaces. At each intersection between two corrugations 25, 26, the metal sheet 24 comprises a node zone 27.

The corrugations 25, 26 of the corrugated metal sheets 24 are accommodated in the grooves 14, 15 provided in the internal plate 10 of the secondary insulating panels 2. The adjacent corrugated metal sheets 24 are lap-welded together. The corrugated metal sheets 24 are anchored on the metal mounting plates 17, 18 by tack welds.

The corrugated metal sheets 24 are, for example, made of Invar®: i.e. an iron and nickel alloy, the expansion coefficient of which is typically between $1.2.10^{-6}$ and $2.10^{-6}$ $K^{-1}$, or a high manganese content iron alloy, the expansion coefficient of which is typically approximately $7.10^{-6}$ $K^{-1}$. Alternatively, the corrugated metal sheets 24 also can be made of stainless steel or aluminum.

The primary thermal insulation barrier 5 comprises a plurality of primary insulating panels 6 of substantially rectangular parallelepiped shape. The primary insulating panels 6 in this case are offset relative to the secondary insulating panels 2 of the secondary thermal insulation barrier 1, so that each primary insulating panel 6 extends over four secondary insulating panels 2 of the secondary thermal insulation barrier 1. The adjacent primary insulating panels 6 are spaced apart by a space 8 ensuring a functional assembly clearance for said primary insulating panels 6. However, this space 8 is smaller compared to the void 12 between two adjacent secondary insulating panels 2 of the secondary thermal insulation barrier 1. Thus, the space 8 separating two primary insulating panels 6 of the primary thermal insulation barrier 5 is approximately 4 mm, plus or minus 3 mm.

The primary insulating panels 6 comprise a structure similar to the secondary insulating panels 2 of the secondary thermal insulation barrier 1, namely a sandwich structure made up of an insulating lining layer, such as an insulating polymer foam layer 29 sandwiched between two rigid internal 30 and external 31 plates, for example, made of plywood. The internal plate 30 of a primary insulating panel 6 is equipped with metal mounting plates 32, 33 for anchoring corrugated metal sheets 39 of the primary sealing membrane 7, in a similar way to the metal mounting plates 17, 18 for anchoring the corrugated metal sheets 24 of the secondary sealing membrane 4. Similarly, the internal 30 and external 31 plates are preferably flat, apart from possible singular zones.

The primary sealing membrane 7 is obtained by assembling a plurality of corrugated metal sheets 39 similar to the corrugated metal sheets 24 of the secondary sealing membrane 4. Each corrugated metal sheet 39 comprises two series of corrugations 40 perpendicular to each other. The corrugations 40 of each of said series of corrugations 40 are parallel to a respective side of the corresponding corrugated metal sheet 39. In the embodiment shown in FIG. 1, the corrugations 40 project toward the inside of the tank. The corrugated metal sheets 39 are, for example, made of stainless steel or aluminum.

Other details and other embodiments, in particular relating to the secondary 1 and primary 5 thermal insulation barriers, the anchoring components of the thermally insulating barriers 1 and 5 and the sealing membranes 4 and 7, can be found in document WO 2016/046487, document WO 2013/004943 or even document WO 2014/057221.

In such a tank, the corrugations 25, 26 of the secondary sealing membrane 4 form a meshwork of circulation channels. Such channels continuously extend between the secondary sealing membrane 4 and the primary thermal insulation barrier 5 throughout the tank wall. Such channels thus promote convection movements, in particular on the tank walls with a significant vertical component, such as the transverse tank walls. This meshwork of continuous channels can generate thermosiphon phenomena in the primary thermal insulation barrier 5. One aspect of the invention is based on the idea of preventing these convection movements in the walls of the tank.

Figure 2:
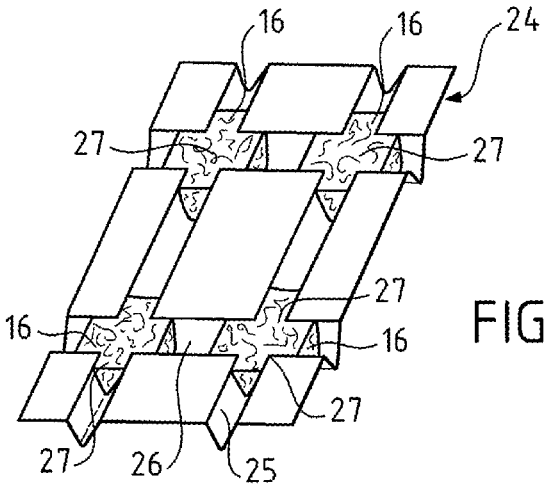
FIG. 2 is a partial perspective view of the section II-II of FIG. 1 showing a first embodiment of the invention.

FIG. 2 shows a partial perspective view of the section II-II of FIG. 1 at an intersection between the corrugations 25, 26 of the secondary sealing membrane 4 according to a first embodiment of the invention. Identical elements or elements fulfilling the same function as those described above use the same reference signs.

In FIG. 2, only two corrugations 25 of the first series of corrugations 25 and two corrugations 26 of the second series of corrugations 26 are shown, with these corrugations 25, 26 forming, at their intersections, nodes 27 of the secondary sealing membrane 4. The following description for these corrugations 25, 26 and nodes 27 is similarly applicable to all the corrugations 25, 26 and to all the nodes 27 of the secondary sealing membrane 4.

One aspect of the invention is based on the idea of limiting the length of the channels formed by the corrugations 25, 26 of the secondary sealing membrane 4. According to the first embodiment of the invention, insulating lining filler blocks 16 are inserted into one, some, or all the nodes 27 of the secondary sealing membrane 4. These filler blocks 16 are disposed in the nodes 27 on an internal face of the corrugated metal sheets 24, so as to be arranged between the secondary sealing membrane 4 and the primary thermal insulation barrier 5. In FIG. 2, such a filler block 16 is disposed in each node 27 of the secondary sealing membrane 4.

Such a filler block 16 assumes the form of a cross-shaped insulating block extending into the node 27 into which it is inserted and projecting into portions of the grooves 25, 26 forming said node 27. Furthermore, such a filler block 16 has a section with a shape matching the shapes of the node 27 and the portions of the grooves 25, 26 into which said filler block 16 is inserted. In this first embodiment, the filler blocks 16 are inserted into the nodes 27 and the portions of the corresponding corrugations 25, 26 after the installation of the secondary sealing membrane 4 on the secondary thermal insulation barrier 1, and prior to the installation of the primary insulating panels 6 on the secondary sealing membrane 4.

The filler block 16 can be made of any material that allows a load loss in the channels formed by the corrugations 25, 26. Thus, the filler blocks 16 can be made, for example, of foam, felt, glass wool, wood or other materials.

Preferably, the filler blocks 16 are formed in a flexible foam that allows the compression thereof. Such a flexible foam allows the filler blocks 16 to be designed with dimensions that are slightly greater than the dimensions of the nodes 27 and of the portions of the corrugations 25, 26, so as to accommodate the filler blocks 16 in said nodes 27 and portions of the corrugations 25, 26, with a slight compression of said filler blocks 16, so as to conform to the shapes of the node 27 as closely as possible.

Furthermore, the filler blocks 16 are preferably made of an open cell foam. Such an open cell foam allows the convection phenomenon to be limited by producing a load loss in the thermal movements inside the channels formed by the corrugations 25, 26, whilst allowing gas, such as an inert gas, to circulate inside the primary thermal insulation barrier 5, as explained above for the wadding 13.

Thus, the filler blocks 16 form plugs limiting the length of the channels formed by the corrugations 25, 26. Typically, each corrugation forms a plurality of discontinuous channels each formed by a section of said corrugation 25, 26 lying between two successive nodes 27. Such channels limited to the sections of the corrugations 25, 26 located between two adjacent nodes 27 do not allow a significant convection phenomenon to be created and, in particular, prevent the creation of a thermosiphon phenomenon.

In embodiments, not shown, filler blocks 16 are arranged in some nodes 27 only and not in all the nodes 27. Thus, for example, such filler blocks 16 are disposed in all the nodes 27 adjacent to the edges of the corrugated metal sheet 24 forming said nodes 27. In another example, only one node 27 in two or three along a corrugation 25 and/or 26 is filled with a filler block 16.

Figure 3:
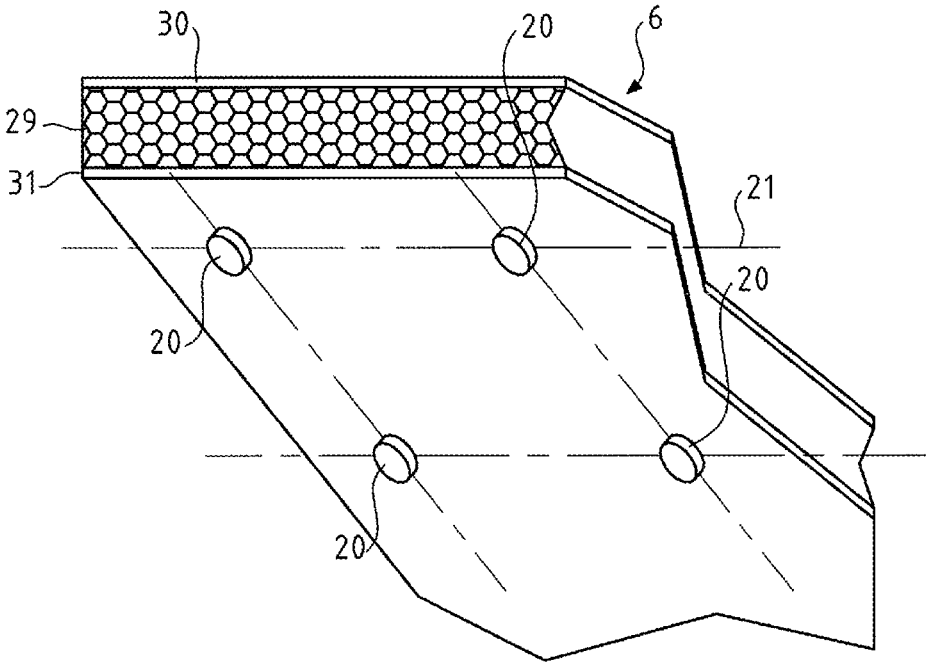
FIG. 3 is a schematic perspective bottom view of an insulating panel of the primary thermal insulation barrier according to an alternative embodiment of the first embodiment of the invention.

FIG. 3 is a schematic perspective bottom view of a primary insulating panel 6 of the primary thermal insulation barrier 5 according to an alternative embodiment of the first embodiment of the invention. Identical elements or elements fulfilling the same function as those described above use the same reference signs.

In this alternative embodiment of the first embodiment of the invention, the filler blocks 16 are formed by pads 20 arranged on an external face of the external plate 31 of the primary insulating panels 6, i.e. on the face of the external plates 31 opposite the insulating polymer foam layer 29 of said panels 6. Such pads 20 are made of any suitable material, such as the materials cited above for producing the cross-shaped filler block 16. In FIG. 3, these pads assume the shape of a cylindrical shaped flexible open cell foam block. Such pads 20 are fixed on the external plate 31 using any suitable means, for example, by bonding, clasping, double-sided tape or other means. This step of fixing pads 20 on the primary insulating panels 6 thus advantageously can be performed when manufacturing said primary insulating panels 6, i.e. prior to the manufacture of the tank.

The pads 20 are arranged on the external plate 31 so as to be inserted into the nodes 27 when the primary insulating panels 6 are positioned on the secondary sealing membrane 4. Thus, FIG. 3 schematically shows the corrugations 25, 26 forming a meshwork 21 of corrugations 25, 26 of the secondary sealing membrane 4 under the primary thermal insulation barrier 5. As shown in FIG. 3, the pads 20 are arranged on the external plate 31 so that each is located on a node 27 formed by the intersection of corrugations 25 and 26 of the secondary sealing membrane 4.

Thus, contrary to the cross-shaped filler blocks 16 inserted into the nodes 27 prior to the installation of the primary insulating panels 6, as described above with reference to FIG. 2, this alternative embodiment of the first embodiment does not require a step of installing filler blocks in the nodes 27, with the pads being directly inserted into said nodes 27 when the primary insulating panels 6 are positioned in the tank.

FIG. 3 shows four pads 20 that each must be inserted into a respective node 27. However, in a similar manner to the filler blocks 16 and as explained above, the number and the arrangement of said pads 20 can be modified to fill all or only some of the nodes 27.

Figure 4:
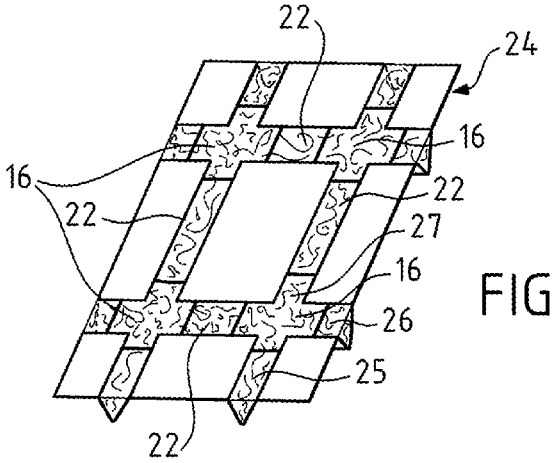
FIG. 4 is a partial perspective view of the section II-II of FIG. 1 showing a second embodiment of the invention.

FIG. 4 is a partial perspective view of the section II-II of FIG. 1 according to a second embodiment of the invention. Identical elements or elements fulfilling the same function as those described above use the same reference signs.

This second embodiment differs from the first embodiment in that the sections of the corrugations 25, 26 located between two successive nodes 27 are also filled with a heatproof lining. Thus, in addition to the cross-shaped filler blocks 16 accommodated in the nodes 27, the tank comprises filler bars 22 accommodated in the sections of the corrugations 25, 26 located outside the nodes 27. Such filler bars 22 can be made of materials such as those described above with reference to the cross-shaped filler blocks 16. Advantageously, the bars 22 are manufactured from a material that allows inert gas to circulate in the corrugations 25, 26, whilst generating a load loss in the thermal circulation flows inside the corrugations 25, 26, preventing the creation of thermosiphons through convection in said corrugations 25, 26.

Similarly, these filler bars 22 are designed so as to preferably assume a section shape that matches the sections of the corrugations 25, 26, so as to block the channels formed by said corrugations 25, 26. These filler bars 22 also can assume other shapes, for example, a circular shape so as to be compressed by the external plate 31 of the primary insulating panel 6 disposed above, in order to occupy a significant portion of the section of the corresponding corrugation 25, 26, for example, at least 80% of said corrugation 25, 26.

Figure 5:
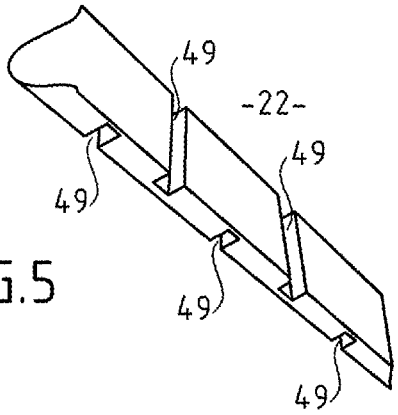
FIG. 5 is a schematic perspective view of an example of a filler bar.

Thus, according to a preferred embodiment shown in FIG. 5, the filler bars 22 are produced in the form of 5 to 15 cm long bars with a section corresponding to the entire section of the corrugation 25, 26 into which said bar is inserted. This bar is advantageously made of extruded polystyrene with density of 8 to 30 kg/m^3. Ideally, the bar has an excess height of 1 to 2/10e mm corresponding to installation related crushing and to a slight thermal contraction. Advantageously, the bar also has a serration 49 in its profile, so that the load loss that it generates under increasing flow speeds is significant, but so that the load loss at low speed is limited so as not to completely obstruct the circulation of gas in the corrugations 25, 26.

Figure 6:
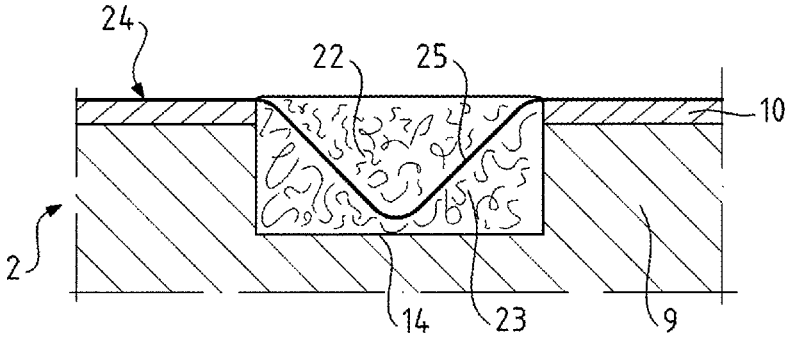
FIG. 6 is a section view showing the second embodiment of the invention along the cross-section III-III of FIG. 1.

FIG. 6 shows a section view of a corrugation 25 of the secondary sealing membrane 4 accommodated in a groove 14 of a secondary insulating panel 2 of the secondary thermally insulating barrier along the section III-III of FIG. 1, according to an alternative embodiment of the second embodiment of the invention, as described with reference to FIG. 4. Identical elements or elements fulfilling the same function as those described above use the same reference signs. Furthermore, the following description with reference to FIG. 6 for a corrugation 25 accommodated in a groove 14 is similarly applied to one or more other grooves 14 and/or 15.

As shown in FIG. 6, the groove 14 completely passes through the thickness of the internal plate 10 and emerges at the insulating polymer foam layer 9. The groove 14 is designed so as to provide a positioning clearance for the corrugation 25 accommodated in said groove 14 when the corresponding corrugated metal sheet 24 is installed on the secondary insulating panel 2 comprising said groove 14. This clearance also must allow the relative movements between the corrugation and the walls of the groove 14 that are generated by the differences in contractions and expansions.

As the corrugations 25, 26 form a meshwork of channels promoting, through convection, the formation of a thermosiphon in the primary thermal insulation barrier 5, the grooves 14, 15 form a meshwork in the secondary thermal insulation barrier 1, also forming a meshwork of channels that can be the source of such a phenomenon of thermosiphoning through convection.

In order to avoid this phenomenon, the alternative embodiment of the second embodiment differs from the alternative embodiment described with reference to FIG. 4 in that it comprises, in addition to the filler blocks 16 in the nodes 27 and the filler bars 22 in the corrugations 25, 26, a third filler block 23 disposed in the grooves 14, 15 of the internal plates 10 of the secondary insulating panels 2.

As shown in FIG. 6, this third filler block 23 is positioned in the grooves 14 in order to generate a load loss in the cold circulation in the meshwork formed by the grooves 14, 15. This third filler block 23 is similar to the filler block 16 and to the filler bar 22 and can be made from various materials. Preferably, this wadding is made of open cell flexible foam so as not to prevent the circulation of inert gas and/or the detection of leaks in the secondary thermal insulation barrier 1. This third filler block 23 is installed in the groove 14 prior to the installation of the corresponding corrugated metal sheet 24.

Preferably, this third filler block 23 is compressible and is compressed by the corrugation 25 of the corrugated metal sheet 24 in order to ensure the proper distribution thereof throughout the whole groove 14. In particular, it is preferable that highly deformable materials (ultrahigh density expanded polystyrene (<10 kg/m^3), melamine foam, flexible low-density polyurethane foam) are used for this third filler block 23 that are crushed when the corrugated metal sheet 24 is installed. In another embodiment, the third filler block is produced in the form of adaptable elements, made of resin or rigid low-density polyurethane foam, for example, which are deposited into the groove 14 just prior to the installation of the corrugated metal sheet 24, the corrugation of which must be accommodated in said groove 14.

FIG. 6 shows the use of the third filler block 23 in a corrugation 25 of the secondary metal sheet 24. However, within the scope, not shown, of a primary sealing membrane 7 having outward corrugations 40, i.e. projecting toward the outside of the tank and accommodated in corresponding grooves produced in the internal plates 31 of the primary insulating panels 6, the third filler block 23 can be used in a similar manner to fill the channels formed by said grooves produced in the internal plate 31 of the primary insulating panels 6.

Figure 7:
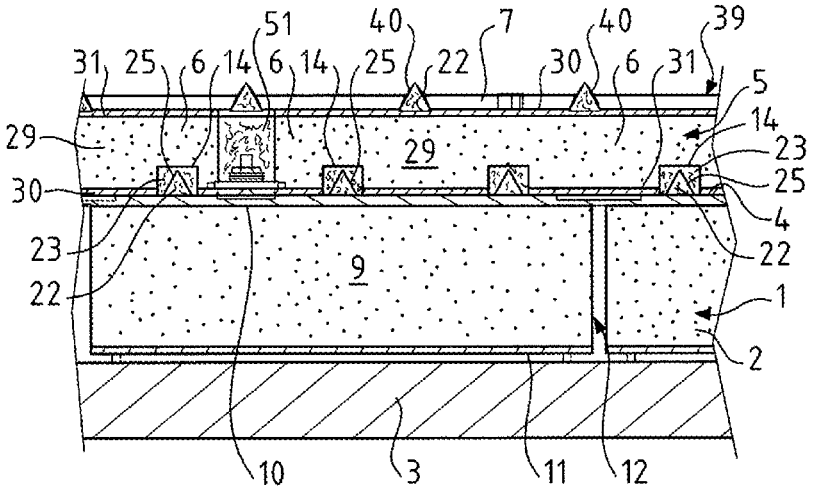
FIG. 7 shows a section view of a wall of a sealed and thermally insulating tank according to a third embodiment of the invention.

FIG. 7 shows a section view of a wall of a sealed and thermally insulating tank according to a third embodiment of the invention. Identical elements or elements fulfilling the same function as those described above use the same reference signs.

This third embodiment differs from the second embodiment in that the corrugations 25, 26 of the secondary sealing membrane 4, as well as the corrugations 40 of the primary sealing membrane 7, are inward corrugations, i.e. projecting toward the inside of the tank. Thus, the grooves 14, 15 housing the corrugations 25, 26 of the secondary sealing membrane 4 are formed in the external plates 30 of the primary insulating panels 6. Consequently, the filler block 16 and the filler bar 22 are arranged between the corrugated metal sheets 24 and the internal plates 10 of the secondary insulating panels 2. Furthermore, the third filler block 23 is accommodated in the grooves 14, 15 provided in the external plates 30 of the primary insulating panels 6 between said primary insulating panels 6 and the corrugations 25, 26 of the secondary sealing membrane 4.

Furthermore, as shown in FIG. 7, the filler block 16 and the filler bar 22 also can be positioned under the corrugations 40 of the primary sealing membrane 7, between said corrugations 40 and the internal plate 31 of said primary insulating panels 6. An insulating lining 51 also can be positioned in shafts produced in the corners of the primary insulating panels 6 for accommodating the anchoring components 19. As in the preceding embodiments, it is possible to install a filler block in all or only some of the nodes and/or corrugations of the secondary 4 and/or primary 7 sealing membrane and/or grooves accommodating said corrugations.

Figure 8:
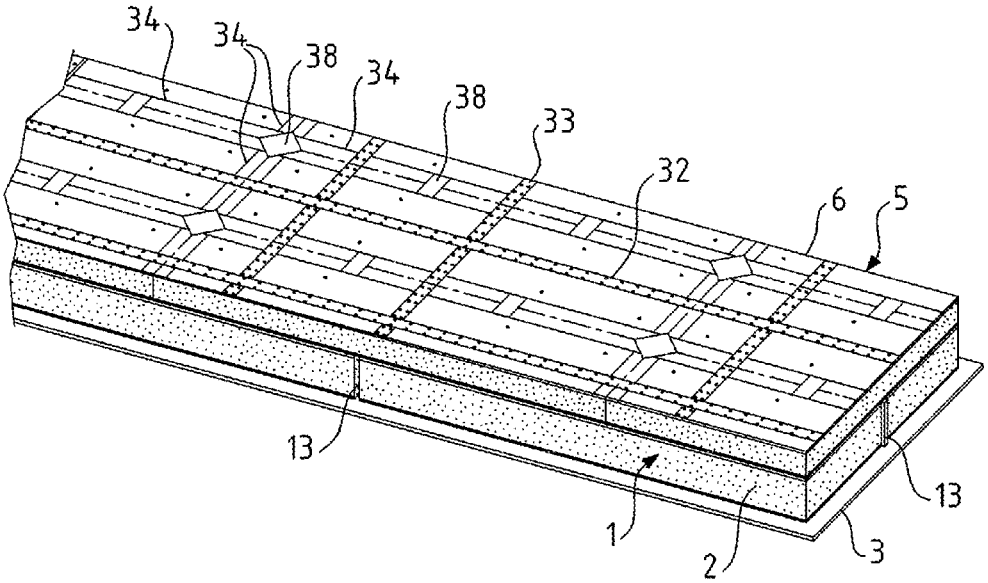
FIG. 8 is a schematic partial perspective view of a sealed and thermally insulating tank according to a fourth embodiment, in which the primary sealing membrane is not shown.

FIG. 8 is a partial perspective view of the sealed and thermally insulating tank, in which the primary sealing membrane is not shown, according to a fourth embodiment of the invention. Identical elements or elements fulfilling the same function as those described above use the same reference signs.

In FIG. 8, the space 8 between two primary insulating panels 6 is shown with broken lines 28. In a similar manner to the corrugations 25, 26 and to the grooves 14, 15, the spaces 8 between the primary insulating panels 6 therefore form a meshwork forming circulation channels allowing, through convection, cold to circulate toward the secondary sealing membrane 4 and allowing a thermosiphon to form that are detrimental to the insulation of the tank wall, in particular, due to the fact that the primary sealing membrane 7 in contact with the LNG contained in the tank is supported by said primary insulating panels 6.

The invention according to the fourth embodiment provides for the installation of anti-convection cover plates 34 disposed between the adjacent primary insulating panels 6 in line with the spaces 8 between said adjacent primary insulating panels. Such anti-convection plates 34 can be made of numerous materials. Preferably, these anti-convection plates are made of continuous non-porous or low porous materials. Thus, the anti-convection cover plates 34 are, for example, films made of paper, cardboard or even synthetic, plastic or other films. Such anti-convection plates can be arranged in line with all the spaces 8, as shown in FIG. 8, or even with only some of said spaces 8.

Figure 9:
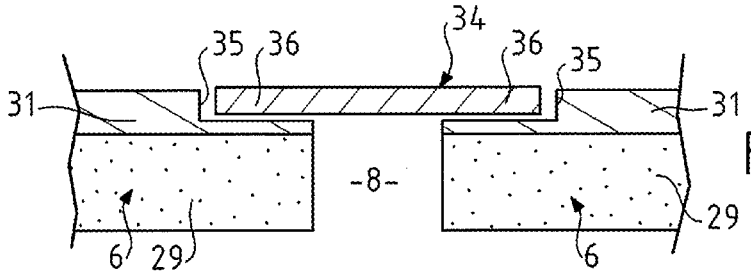
FIG. 9 is a partial section view of a void between two insulating panels of the primary thermally insulating barrier of FIG. 7.

With reference to FIG. 9, the anti-convection cover plate 34 extends along the primary insulating panels 6 in line with the space 8 between said primary insulating panels 6. An internal edge of the internal plate 31 of said primary insulating panels 6 comprises a countersink 35, in which a corresponding edge 36 of the anti-convection cover plate 34 is accommodated, so that the anti-convection cover plate 34 is flush with the internal face of said internal plate 31. Thus, the anti-convection cover plate 34 covers the space 8 and separates the space 8 from the primary sealing membrane 7, preventing the formation of channels with different temperatures likely to generate a thermosiphon phenomenon in the meshwork formed by the spaces 8 of a tank wall.

Preferably, the anti-convection plate is made of sealed material that is between 0.2 mm and 2 mm thick. This sealed material is, for example, a plastic material (PEI, PVC, etc.), cardboard, thick laminated paper, a fiberboard or other.

The width of the anti-convection cover plate 34 is selected so that the anti-convection plate rests in the countersinks 35 on a minimum bearing surface, for example, of at least 10 mm, for any contraction of the internal plates 31 and of said anti-convection cover plate 34. In other words, the anti-convection cover plate 34 is designed so that its edges 36 are accommodated in the countersinks 35, including when the tank is full of LNG. To this end, one of the edges 36 of the anti-convection plate can partially emerge from the countersink 35 so as to cover the internal plate 31 outside the countersink 35, in order to ensure that said edge 36 remains accommodated in the countersink in its contracted state. The edges 36 of the anti-convection cover plate 34 are clasped or bonded onto one of the two primary insulating panels 6 in the countersink 35.

As shown in FIG. 8, the primary thermal insulation barrier 5 comprises a plurality of closure plates 38 allowing the bearing surface of the primary sealing membrane 7 to be completed in the vicinity of shafts for accommodating the anchoring components 19 of the primary thermal insulation barrier 5. With these shafts being disposed in the extension of the spaces 8 between the primary insulating panels 6, the anti-convection cover plates 34 can be interrupted at said closure plates 38. Preferably, in this case, the anti-convection cover plates 34 are joined to said closure plates 38 so as to limit the presence of passages between the primary sealing membrane 7 and the spaces 8. Preferably, the anti-convection cover plates 34 and the closure plates 38 are flush with the internal plates 31 of the primary insulating panels 6, so as to form a continuous flat surface for the primary sealing membrane 7.

In an alternative embodiment, not shown, the anti-convection plates 34 at least partially cover the closure plates 38. The ends of the anti-convection cover plates 34 are, for example, accommodated in countersinks (not shown) provided in the closure plates 38, so that the closure plates 38 and the anti-convection plates 34 are flush with the internal plates 31 of the primary insulating panels 6.

In another alternative embodiment, the anti-convection plates 34 are continuous and fully cover the closure plates 38. Preferably, the anti-convection cover plates 34 are flush with the internal plates 31 of the primary insulating panels 6.

In another preferred alternative embodiment, the anti-convection cover plates 34 are continuous and fully cover the closure plates 38. Preferably, the anti-convection cover plates 34 are flush with the internal plates 31 of the primary insulating panels 6, including when they pass above the closure plates 38.

Figure 17:
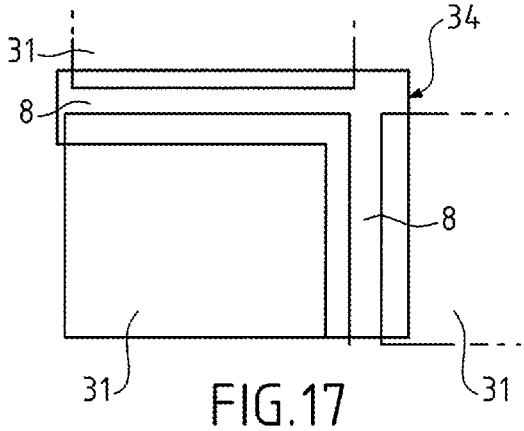
FIG. 17 is a schematic presentation of the internal plates of three adjacent primary insulating panels, on which an L-shaped anti-convection plate rests, according to an alternative embodiment of the fourth embodiment of the invention.

In another alternative embodiment, schematically shown in FIG. 17, the anti-convection plates 34 assume an "L" shape, i.e. the same anti-convection cover plate 34 covers two joining edges of the internal plate 30 of the same primary insulating panel 6 and is therefore located in line with the spaces 8 formed by said primary insulating panel 6 and two adjacent primary insulating panels 6. The internal plates 31 of the primary insulating panels 6 thus accommodate two anti-convection cover plates, so that all the spaces 8 are gradually blocked.

Figure 10:
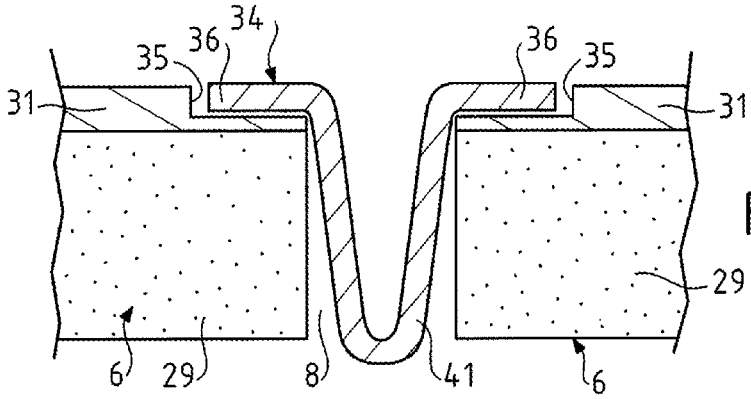
FIG. 10 is a partial section view of a void between two insulating panels of the primary thermally insulating barrier according to an alternative embodiment of FIG. 9.

In an alternative embodiment of this fourth embodiment shown in FIG. 10, the anti-convection cover plate 34 is folded so that a central portion 41 of the anti-convection cover plate 34 connecting the two lips 36 is accommodated in the space 8 separating the adjacent primary insulating panels 6. As an alternative embodiment, the second edge of the cover plate 34 could be supported along the lateral face of the second primary insulating panel 6 without departing from the space 8.

FIGS. 11 to 15 show various alternative embodiments of a fifth embodiment of the invention.

This fifth embodiment differs from the fourth embodiment shown in FIGS. 8 to 10 in that the anti-convection cover plate 34 is replaced by an anti-convection filler strip 37 accommodated in the space 8. Identical elements or elements fulfilling the same function as those described above use the same reference signs. Such an anti-convection strip preferably is compressible. This anti-convection strip is inserted into the space 8 between the primary insulating panels 6 following the installation of said primary insulating panels 6 on the secondary sealing membrane 4. To this end, the anti-convection strip is, if necessary, compressed thickness-wise in order to be inserted between the primary insulating panels 6, possibly forcibly.

This anti-convection filler strip 37 can be produced in numerous manners. In one embodiment which is not part of the invention, the anti-convection filler strip 37 can be made of a porous material forcibly inserted into the space 8, in order to have a significant pre-stress allowing the modifications of the dimensions of the space 8 to be filled. Such an anti-convection filler strip 37 made of porous material is particularly adapted for large spaces 8, for example, between 10 mm and 100 mm. Such a porous material can be glass wool, for example, ideally made up of stacked layers.

However, as explained above with reference to FIG. 1, the space 8 between two primary insulating panels 6 can be relatively narrow, typically approximately 4 mm, plus or minus 3 mm. Such a limited space cannot be reliably filled by inserting a very thin insulating lining, unlike the voids 12 between the secondary insulating panels 2. Indeed, the roughness of the primary insulating panels 6 could damage such a very thin insulating lining when it is inserted. This roughness is, among other things, associated with the presence of glass fibers in the insulating foam layer 29 of the primary insulating panels 6. Thus, in a solution which is not part of the invention, sheets of sealed materials (not shown) are incorporated between the glass wool layers, in order to separate the overall volume of the anti-convection filler strip 37 into distinct layers only experiencing a slight thermal gradient and having sufficient resistance to allow the anti-convection filler strip 37 to be inserted without damaging the space 8.

Figure 11:
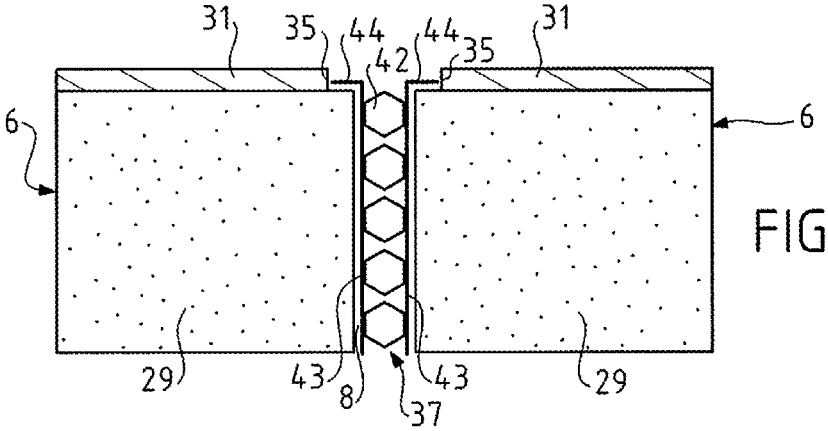
FIGS. 11 to 15 are partial section views of a void between two insulating panels of the primary thermally insulating barrier according to a fifth embodiment.

FIG. 11 shows an embodiment of the anti-convection filler strip 37. The anti-convection filler strip 37 has a multilayer structure comprising a compressible core 42. Thus, in FIG. 11 showing an embodiment of this fifth embodiment, the anti-convection filler strip 37 comprises two sheets 43 each comprising a lip 44 accommodated in a respective countersink 35 of the primary insulating panels 6. This lip 44 is clasped in the countersink 35, thus allowing said lips 44 to remain in the countersinks 35, even during the modification of the dimensions of the space 8 between the primary insulating panels 6, for example, during the contraction associated with the introduction of LNG into the tank.

Each sheet 43 extends into the space 8 between the primary insulating panels 6 along said primary insulating panels 6, from the countersink 35 toward the secondary sealing membrane 4. The two sheets 43 are connected by the compressible core 42 accommodated in the space 8 between the primary insulating panels 6. The sheets 43 and the compressible core 42 are made of sealed materials, for example, a plastic material (PEI, PVC, etc.), cardboard, thick laminated paper or other material. The sheets 43 and the compressible core 42 thus can be inserted along the primary insulating panels 6 without being damaged by the roughness of said panels 6, even in the case of a narrow space 8.

The compressible core 42 of the anti-convection filler strip 37 can be produced in numerous manners. In the example shown in FIGS. 11 and 12, the compressible core 42 comprises a honeycomb structure made up of a row of cells extending along each of the sheets 43 in the space 8 between the primary insulating panels 6, with each cell being fixed to said two sheets 43 in order to structurally connect said sheets 43. Other examples of compressible cores 42 are shown with reference to FIGS. 13 and 14.

Figure 12:
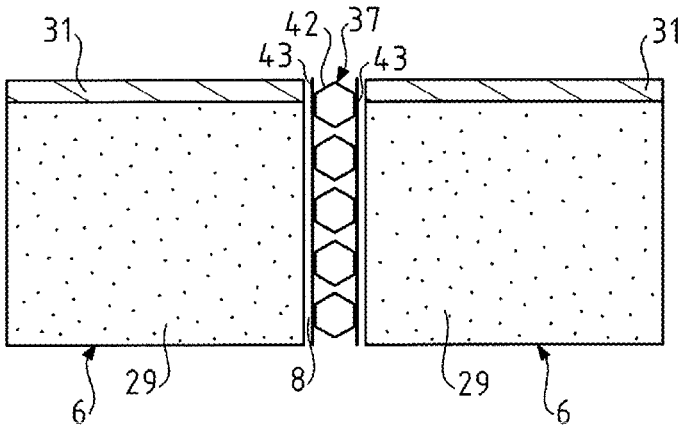
Figure 13:
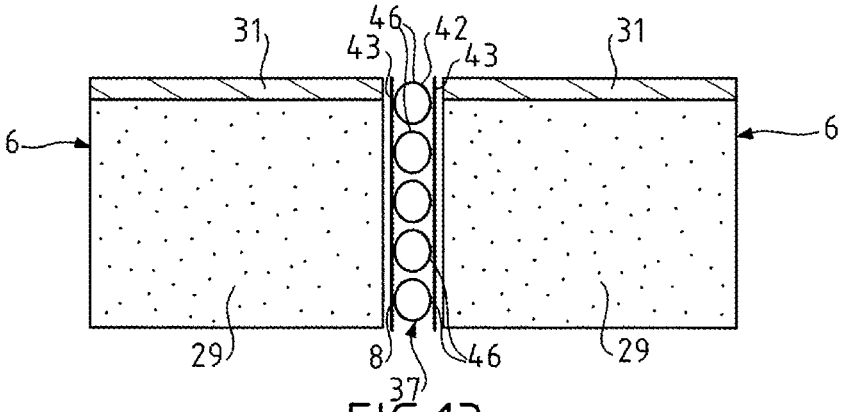

FIGS. 12 to 13 show an alternative embodiment of the anti-convection filler strip 37. This alternative embodiment differs in that the sheets 43 of the anti-convection filler strip 37 do not comprise a lip 44 and in that the primary insulating panels 6 do not comprise countersinks 35. Thus, the anti-convection filler strip 37 is directly accommodated and extends into the space 8 between the primary insulating panels 6.

In the example shown in FIG. 13, the compressible core 42 is formed by a plurality of tubes 46 separating the two sheets 43 and extending into the space 8 along the primary insulating panels 6.

Figure 14:
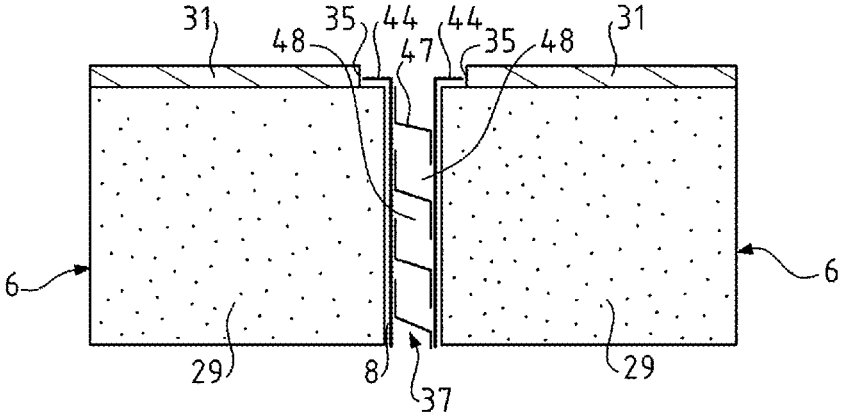

In the example shown in FIG. 14, the compressible core 42 is made up of a plurality of spacers 47 extending between the two sheets 43 and delimiting a plurality of rectangular section cells 48 extending into the space 8 along the primary insulating panels 6.

Figure 15:
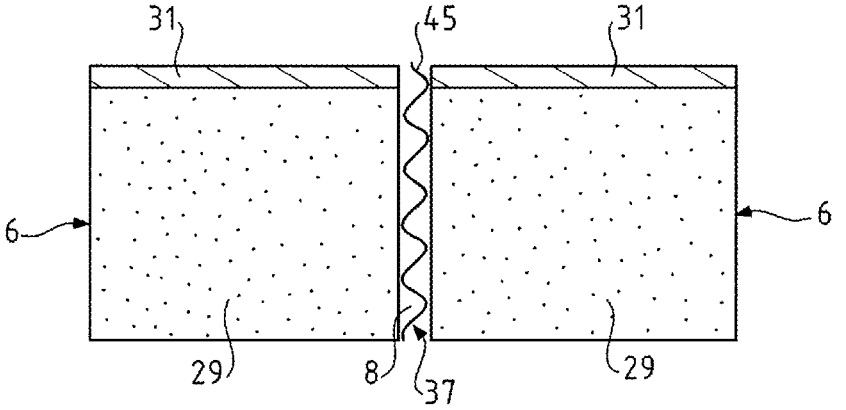

FIG. 15 shows an alternative embodiment of the anti-convection filler strip 37. This alternative embodiment differs in that the anti-convection filler strip 37 is not a multilayer structure but is a single corrugated sheet 45. Such a corrugated sheet 45 separates the space 8 between the primary insulating panels 6 into a plurality of cells continuously extending along said panels 6.

The outline shape of the primary insulating panels 6 and of the secondary insulating panels 2 described above is generally rectangular, but other outline shapes are possible, in particular hexagonal shapes for covering flat walls or suitable outline shapes, which are optionally uneven, for covering special zones of the tank.

Figure 16:
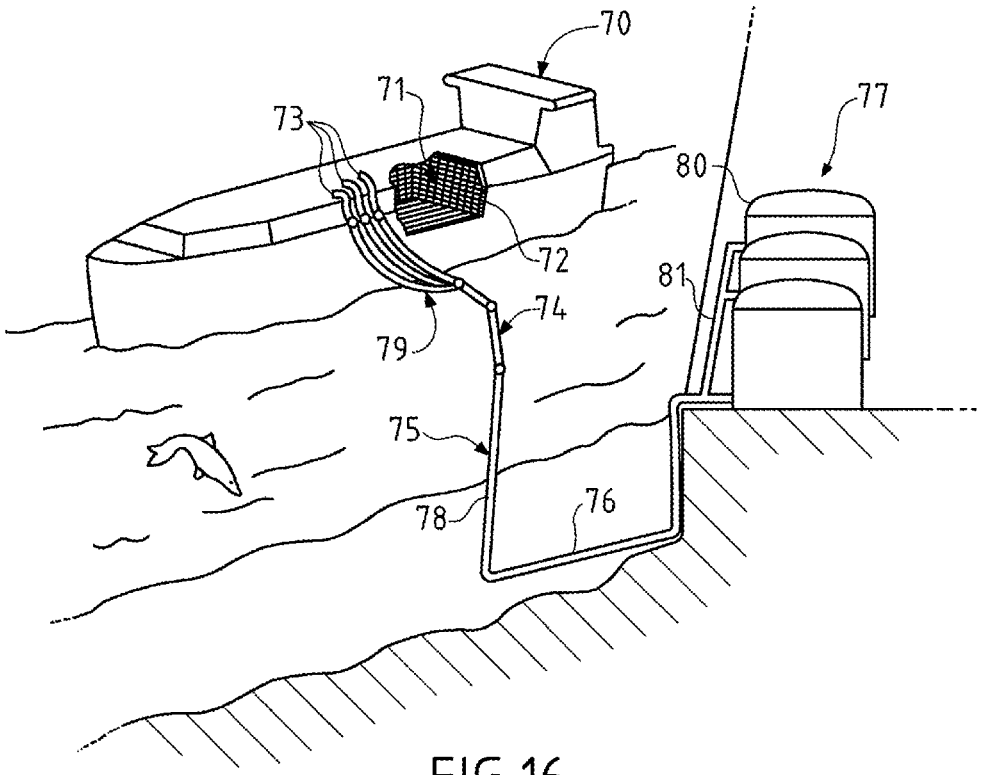
FIG. 16 is a cutaway schematic representation of a tank of an LNG tanker vessel and of a terminal for loading/offloading this tank.

With reference to FIG. 16, a cutaway view of an LNG tanker vessel 70 shows a sealed and insulated tank 71 with a general prismatic shape mounted in the double hull 72 of the vessel. The wall of the tank 71 comprises a primary sealing membrane intended to be in contact with the LNG contained in the tank, a secondary sealing membrane arranged between the primary sealing membrane and the double hull 72 of the vessel, and two insulating barriers respectively arranged between the primary sealing membrane and the secondary sealing membrane and between the secondary sealing membrane and the double hull 72.

In a manner per se known, loading/offloading pipelines 73 disposed on the upper deck of the vessel can be connected, by means of suitable connectors, to a maritime or harbor terminal for transferring an LNG cargo from or to the tank 71.

FIG. 16 shows an example of a maritime terminal comprising a loading and offloading station 75, an underwater pipe 76 and an onshore installation 77. The loading and offloading station 75 is a fixed offshore installation comprising a movable arm 74 and a turret 78, which supports the movable arm 74. The movable arm 74 supports a bundle of insulated flexible hoses 79 that can be connected to the loading/offloading pipelines 73. The orientable movable arm 74 adapts to all forms of LNG tankers. A connection pipe, not shown, extends inside the turret 78. The loading and offloading station 75 allows the vessel 70 to be loaded and offloaded from or to the onshore installation 77, which comprises liquefied gas storage tanks 80 and connection pipes 81 connected by the underwater pipe 76 to the loading or offloading station 75. The underwater pipe 76 allows the liquefied gas to be transferred between the loading or offloading station 75 and the onshore installation 77 over a considerable distance, for example, 5 km, which enables the LNG tanker vessel 70 to be kept at a considerable distance from the shore during the loading and offloading operations.

In order to generate the pressure required to transfer the liquefied gas, pumps on board the vessel 70 and/or pumps equipping the onshore installation 77 and/or pumps equipping the loading and offloading station 75 are used.

Even though the invention has been described in relation to a plurality of specific embodiments, it is obvious that it is by no means limited thereto and that it comprises all the technical equivalents of the means described, as well as their combinations if they fall within the scope of the invention, as defined by the claims.

The use of the verb "comprise" or "include" and of its conjugated forms does not exclude the presence of other elements or other steps than those stated in a claim.

In the claims, any reference sign between brackets cannot be interpreted as a limitation of the claim.

The invention claimed is:

1. A sealed and thermally insulating tank for storing a fluid, wherein a flat tank wall comprises, successively in a thickness direction, a secondary thermal insulation barrier (1) comprising a plurality of juxtaposed secondary insulating elements (2), the secondary insulating elements being retained against a support wall (3), a secondary sealing membrane (4) supported by the secondary insulating elements (2) of the secondary thermal insulation barrier (1), a primary thermal insulation barrier (5) comprising a plurality of juxtaposed primary insulating elements (6), the primary insulating elements being retained against the secondary sealing membrane (4), and a primary sealing membrane (7) supported by the primary thermal insulation barrier (5) and intended to be in contact with the cryogenic fluid contained in the tank, wherein the primary insulating elements (6) comprise flat parallelepiped insulating panels disposed so as to provide voids (8) between them, the primary thermal insulation barrier (5) further comprising an anti-convective filler plate (37), the anti-convective filler plate (37) being made of thin continuous material and having a plurality of elongated wall elements (42, 45, 46, 47) extending over substantially the entire width of the void to delimit cells (48) substantially extending perpendicular to the thickness direction, wherein the plurality of elongated wall elements (42, 45, 46, 47) delimiting the cells (48) are disposed in the void between a first flat parallelepiped insulating panel (6) and a second flat parallelepiped insulating panel, the second parallelepiped insulating panel being adjacent to the first parallelepiped insulating panel.

2. The tank as claimed in claim 1, wherein the elongated wall elements are formed by successive portions of a sheet of corrugated material (45) having alternated parallel corrugations extending substantially perpendicular to the thickness direction.

3. The tank as claimed in claim 1, wherein the filler plate has a sandwich structure comprising two parallel continuous sheets (43) spaced apart by said elongated wall elements (42, 45, 46, 47), said two parallel continuous sheets (43) being arranged against two lateral faces of the first and of the second parallelepiped insulating panel delimiting the void (8).

4. The tank as claimed in claim 3, wherein the elongated wall elements are formed by cylindrical elements (42, 46) extending substantially perpendicular to the thickness direction and fixed between the two parallel continuous sheets.

5. The tank as claimed in claim 3, wherein at least one of the two parallel continuous sheets (43) spaced apart by said elongated wall elements comprises an upper edging portion (44) folded and fixed on the internal face of at least one of the two parallelepiped insulating panels (6) between which the void is formed.

6. The tank as claimed in claim 5, wherein the internal face of the first and/or of the second parallelepiped insulating panel (6) comprises a countersink (35) along the void for accommodating said upper edging portion (44) of the continuous sheet.

7. The tank as claimed in claim 1, wherein the width of the void (8) between the first parallelepiped insulating panel and the second parallelepiped insulating panel (6) is less than 10 mm.

8. The tank as claimed in claim 1, wherein the anti-convective filler plate (37) is made of flexible material, so that the cells can be easily crushed in the widthwise direction of the void.

9. A vessel (70) for transporting a fluid, the vessel comprising a double hull (72) and a tank (71) as claimed in claim 1 disposed in the double hull.

10. A transfer system for a fluid, the system comprising a vessel (70) as claimed in claim 9, insulated pipelines (73, 79, 76, 81) arranged so as to connect the tank (71) installed in the hull of the vessel to a floating or onshore storage installation (77) and a pump for conveying a fluid through the insulated pipelines, from or to the floating or onshore storage installation, to or from the tank of the vessel.

11. A method for loading or offloading a vessel (70) as claimed in claim 9, wherein a fluid is routed through insulated pipelines (73, 79, 76, 81), from or to a floating or onshore storage installation (77), to or from the tank of the ship (71).

12. The tank as claimed in claim 1, wherein the void is defined between a first lateral face of the first flat parallelepiped insulating panel and a second lateral face of the second flat parallelepiped insulating panel, the second lateral face being parallel to the first lateral face, the anti-convective filler plate (37) being straight in a lengthwise direction extending along the first and second flat parallelepiped insulating panels, wherein the plurality of elongated wall elements (42, 45, 46, 47) extends over an entire length of the anti-convective filler plate (37), wherein the elongated wall elements (42, 45, 46, 47) are spaced apart in the thickness direction of the flat tank wall and the cells are mutually spaced in the thickness direction of the flat tank wall, wherein each cell extends over substantially the entire width of the void and over the entire length of the anti-convective filler plate (37).

* * * * *